US006530491B2

(12) United States Patent
Brehmer et al.

(10) Patent No.: US 6,530,491 B2
(45) Date of Patent: Mar. 11, 2003

(54) METHOD AND APPARATUS FOR CREATING AND DISPLAYING SEASONAL AND SPORTS RELATED CHARACTERS

(76) Inventors: Joey R. Brehmer, 535 Pearl St., Lyons, NE (US) 68038; Jamie C. Brehmer, 1460 County Rd. "Q" , Lyons, NE (US) 68038

( * ) Notice: Subject to any disclaimer, the term of this patent is extended or adjusted under 35 U.S.C. 154(b) by 0 days.

(21) Appl. No.: 09/803,532

(22) Filed: Mar. 9, 2001

(65) Prior Publication Data

US 2002/0125380 A1 Sep. 12, 2002

(51) Int. Cl.[7] ..... A47B 57/06; A45F 3/44

(52) U.S. Cl. ..... 211/205; 248/156; 248/149

(58) Field of Search ..... 211/205; 248/149, 248/156, 175; D6/411, 449, 450, 454, 412, 410, 464, 467

(56) References Cited

U.S. PATENT DOCUMENTS

| | | | | | |
|---|---|---|---|---|---|
| 423,066 | A | | 3/1890 | Massey | |
| 585,486 | A | * | 6/1897 | Snow | 211/60.1 |
| 670,144 | A | * | 3/1901 | Bond | 211/205 |
| 887,401 | A | * | 5/1908 | Klotz | 211/182 |
| 1,043,622 | A | | 11/1912 | Miles | |
| 3,524,616 | A | * | 8/1970 | Marschak | 211/205 |
| D285,912 | S | * | 9/1986 | Joffee | D6/412 X |
| 4,892,032 | A | * | 1/1990 | Jerome | 248/278.1 |
| 4,914,857 | A | * | 4/1990 | Dodgen | 248/175 |
| 5,472,102 | A | * | 12/1995 | Clayton | 211/206 |
| 5,566,837 | A | * | 10/1996 | Lema | 211/31 |
| 5,617,958 | A | * | 4/1997 | Laug et al. | 211/60.1 |
| 5,677,018 | A | | 10/1997 | Shin | 428/18 |
| 5,823,360 | A | | 10/1998 | Gorosave | 211/13.1 |
| 5,855,286 | A | * | 1/1999 | Zaid | 211/85.7 |
| D429,922 | S | | 8/2000 | Walker | D6/462 |
| 6,145,795 | A | | 11/2000 | McAdam et al. | 248/146 |

* cited by examiner

*Primary Examiner*—Daniel P. Stodola
*Assistant Examiner*—Erica B Harris
(74) *Attorney, Agent, or Firm*—Thomte, Mazour & Niebergall; Shane M. Niebergall

(57) ABSTRACT

A method and apparatus for supporting and displaying agricultural produce and sporting equipment are provided for forming decorative seasonal and sport related characters. An elongated rod serves as the vertical support for the produce and equipment. For outdoor use the rod can be secured directly into the ground or secured to a stand that is placed on the ground. The stand further allows the apparatus to be used indoors. In use, produce or equipment is either threaded onto the rod, after opposing holes are cut into the produce or equipment, or adjustable ring platforms can be positioned on the rod so that the platforms extend generally perpendicularly from the rod to support the produce or equipment in a vertical manner. An arm platform is provided that can be adjustably secured to the rod and positioned to form the character's arms. The platform is adapted to hold additional produce or equipment as desired. The several component parts to the apparatus can be adapted to be collapsible for storage and provide for a variation of display positions for the character.

17 Claims, 6 Drawing Sheets

METHOD AND APPARATUS FOR CREATING AND DISPLAYING SEASONAL AND SPORTS RELATED CHARACTERS

BACKGROUND OF THE INVENTION

1. Field of the Invention

This invention relates to decorative seasonal and sports displays and more particularly to a method and apparatus for creating and displaying seasonal and sports related characters.

2. Description of the Prior Art

Carved and painted pumpkins are common decorations found in and outside of homes and certain businesses in the fall and during Halloween. Similarly, snowmen and Santa Claus figures adorn many snow-covered lawns throughout the winter. The types of characters formed and displayed year round are usually limited only by the imaginations of the decorators.

However, decorators do occasionally encounter structural limitations when designing decorative seasonal and sports characters. For example, a "pumpkin man" having a segmented body similar to a snowman is a good and versatile idea but for the fact that pumpkins do not naturally adhere to one another when stacked vertically like large snowballs. The same is true when using sport balls and other equipment having round or irregular shapes. Accordingly, an apparatus is needed to facilitate the stacking of various objects having irregular shapes. It is also desirable to be able to use such an apparatus for either indoor or outdoor displays. Finally, the apparatus should be adaptable so that it does not damage the items of agricultural produce or sports equipment used to form the body of the character, making the produce and equipment usable in other applications in the future.

Accordingly, there is a need for an improved method and apparatus for displaying decorative seasonal and sports related characters.

SUMMARY OF THE INVENTION

A method and apparatus are provided for easily creating and displaying decorative seasonal and sports related characters. An elongated rod serves as the central frame or "spine" of the character to be formed. For outdoor use, the rod can be secured directly into the ground for improved stability and support. For indoor and alternative outdoor use, a generally rectangular stand is attached to the bottom of the rod such that the rod extends generally perpendicularly from the stand. Alternatively, the rod can be removably secured to the stand for complete disassembly and storage.

The agricultural produce or sporting equipment can be displayed on the rod in two preferred ways. First, the produce or equipment can have opposing holes, the diameter of which approximating the diameter of the rod, formed into the sides of the produce or equipment so that the rod can be inserted through the opposing holes. A second embodiment uses ring platforms to support the produce or equipment. The ring platforms are adjustably secured to the rod, thus creating a series of shelves disposed in a vertical manner, one over the next.

Additional equipment that can be used includes an arm platform that is removably and adjustably secured to the rod, regardless of the method used for supporting the produce or equipment. The arm extends radially from the rod at a selected vertical distance from the ground and has upper surfaces to "hold" additional items of produce or equipment.

Therefore, a principal object of the invention is to provide an apparatus for displaying decorative seasonal and sports related characters.

Still another object of the invention is to provide an apparatus for creating decorative seasonal and sports related characters for either indoor or outdoor display.

Still another object of the invention is to provide an apparatus for creating decorative seasonal and sports related characters that is fully collapsible for storage purposes.

Still another object of the invention is to provide an apparatus for creating decorative characters using agricultural produce or sports equipment of various sizes and shapes.

Still another object of the invention is to provide an apparatus for creating decorative characters using agricultural produce or sports equipment that is adaptable for different character themes and poses.

Still another object of the invention is to provide an apparatus for creating decorative characters using agricultural produce or sports equipment that does not damage the items of agricultural produce or sporting equipment used.

These and other objects will be apparent to those skilled in the art.

DESCRIPTION OF THE PREFERRED EMBODIMENT

Figure 1:
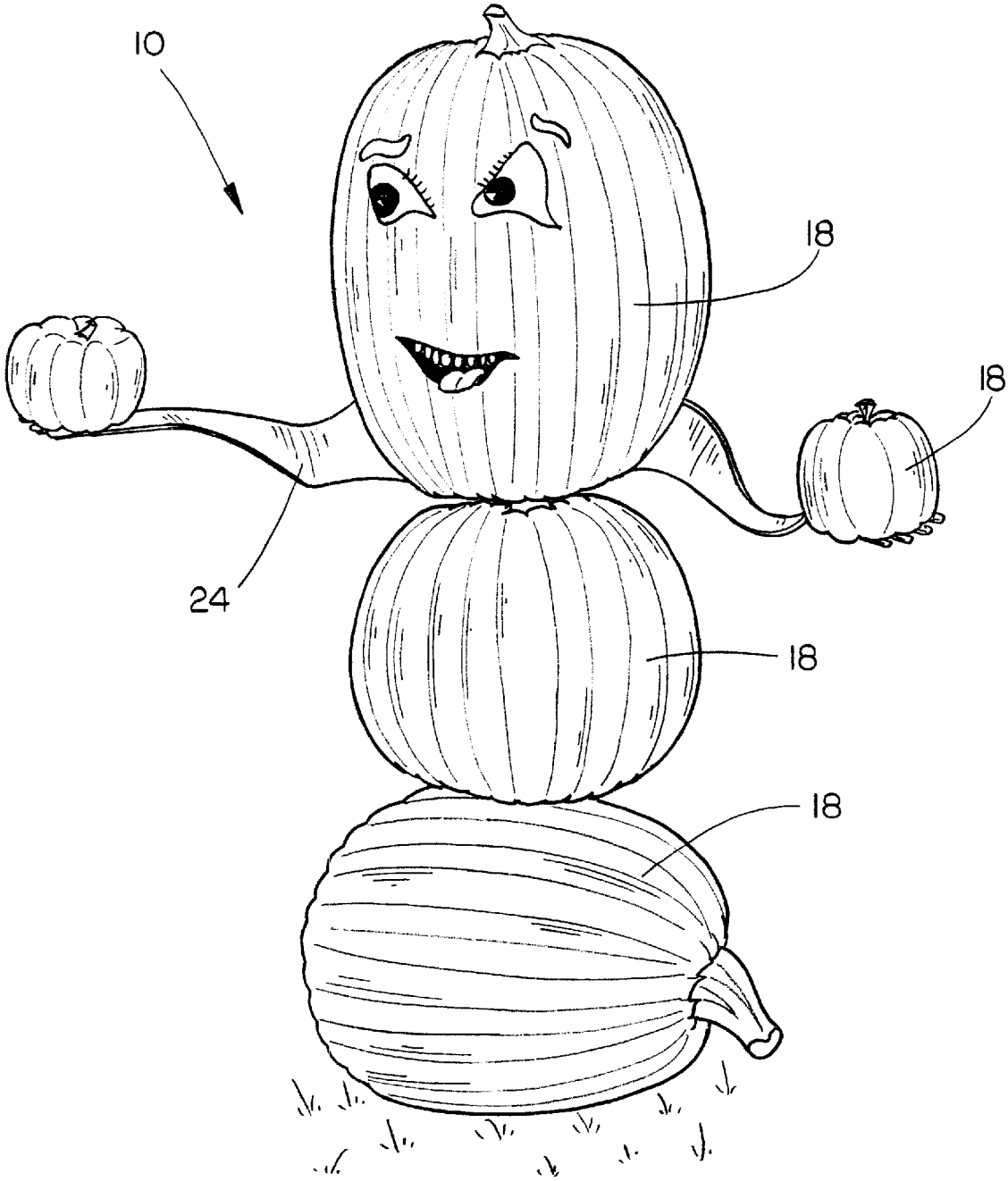
FIG. 1 is a perspective view of the invention in use, displaying a pumpkin man character.
Figure 2:
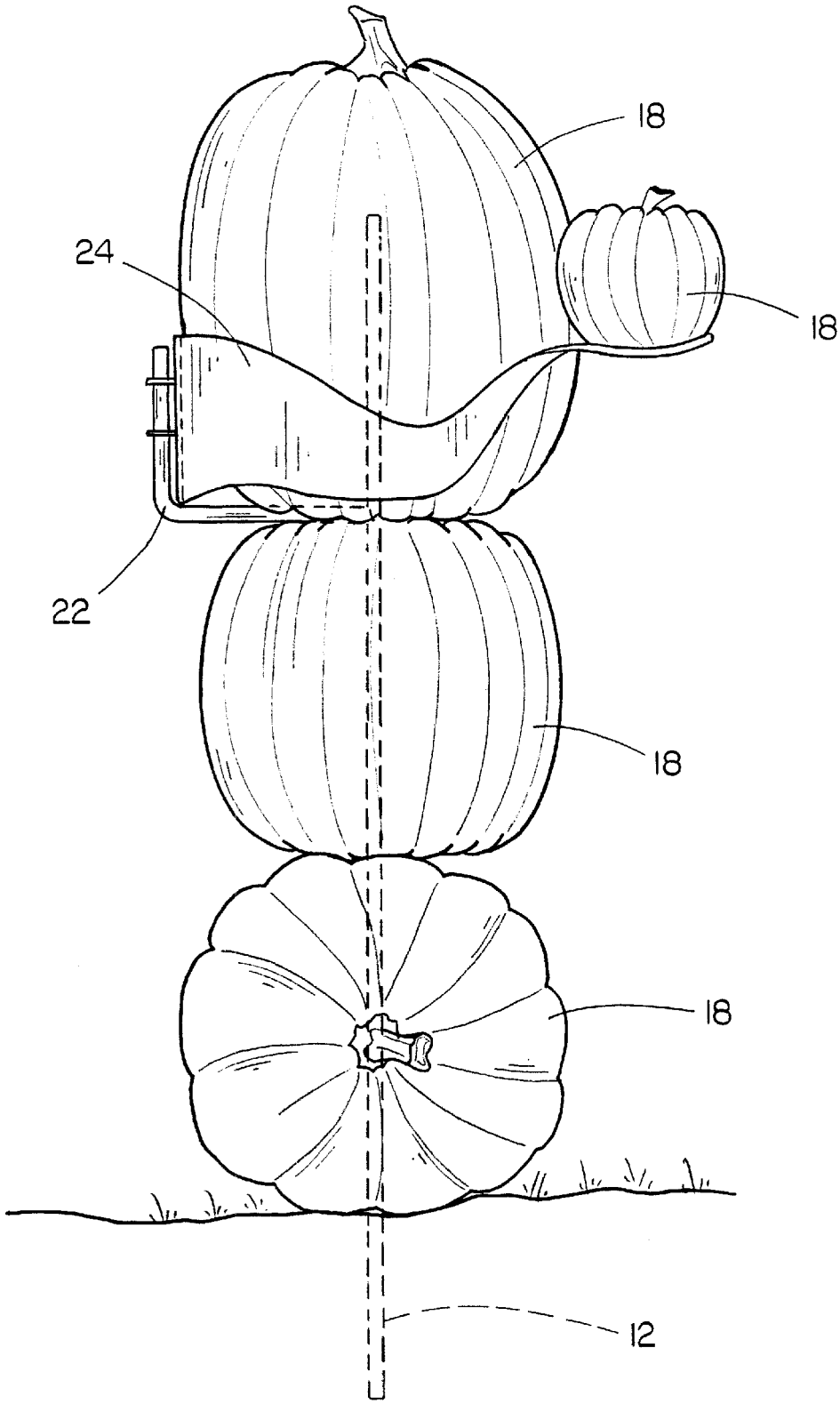
FIG. 2 is a side view of the invention in use, displaying a pumpkin man character, further depicting the rod structure disposed within the pumpkins being used.
Figure 3:
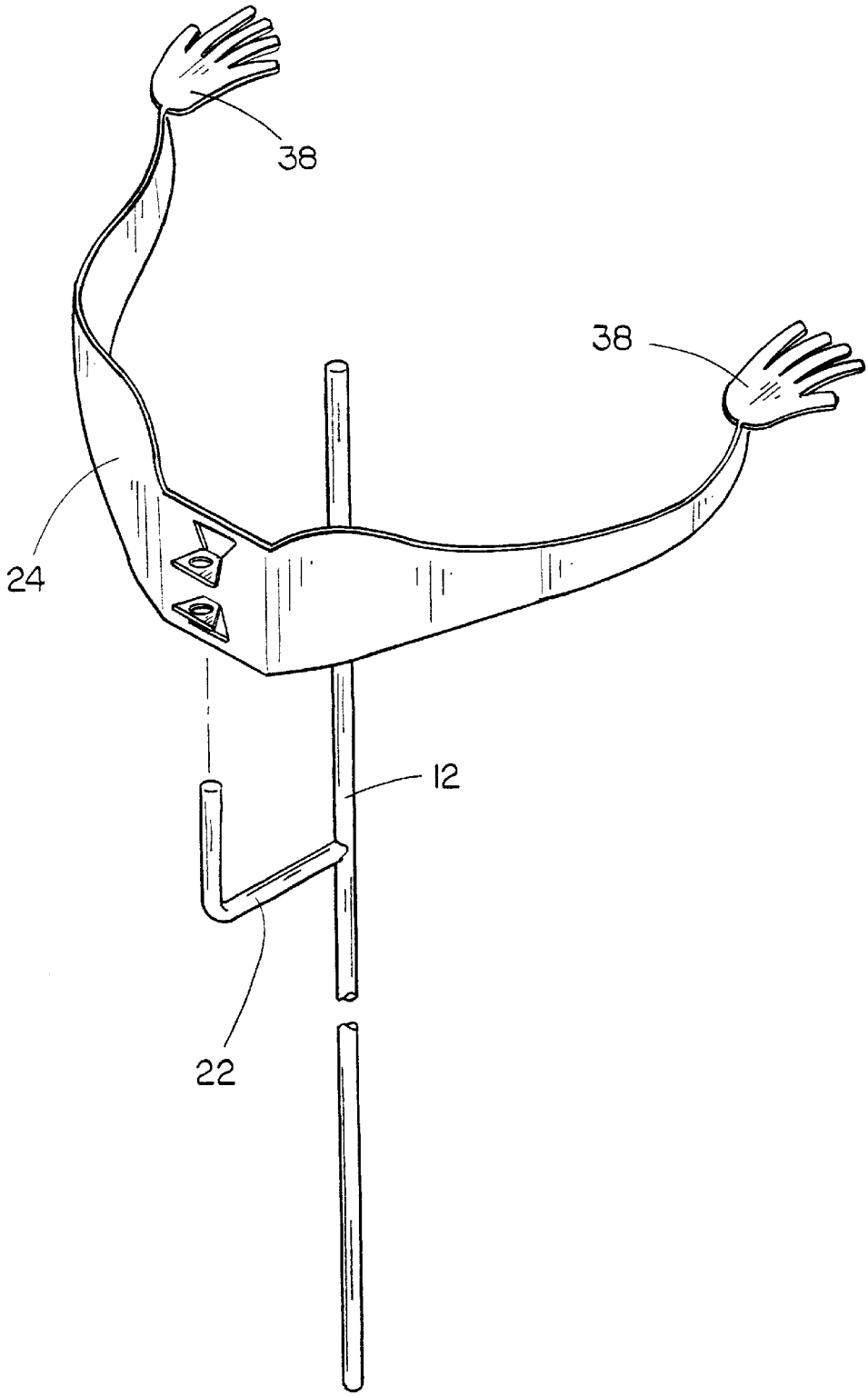
FIG. 3 is a rear perspective view of the rod wherein the angular bracket attached thereto is adapted to receive the arm platform.
Figure 4:
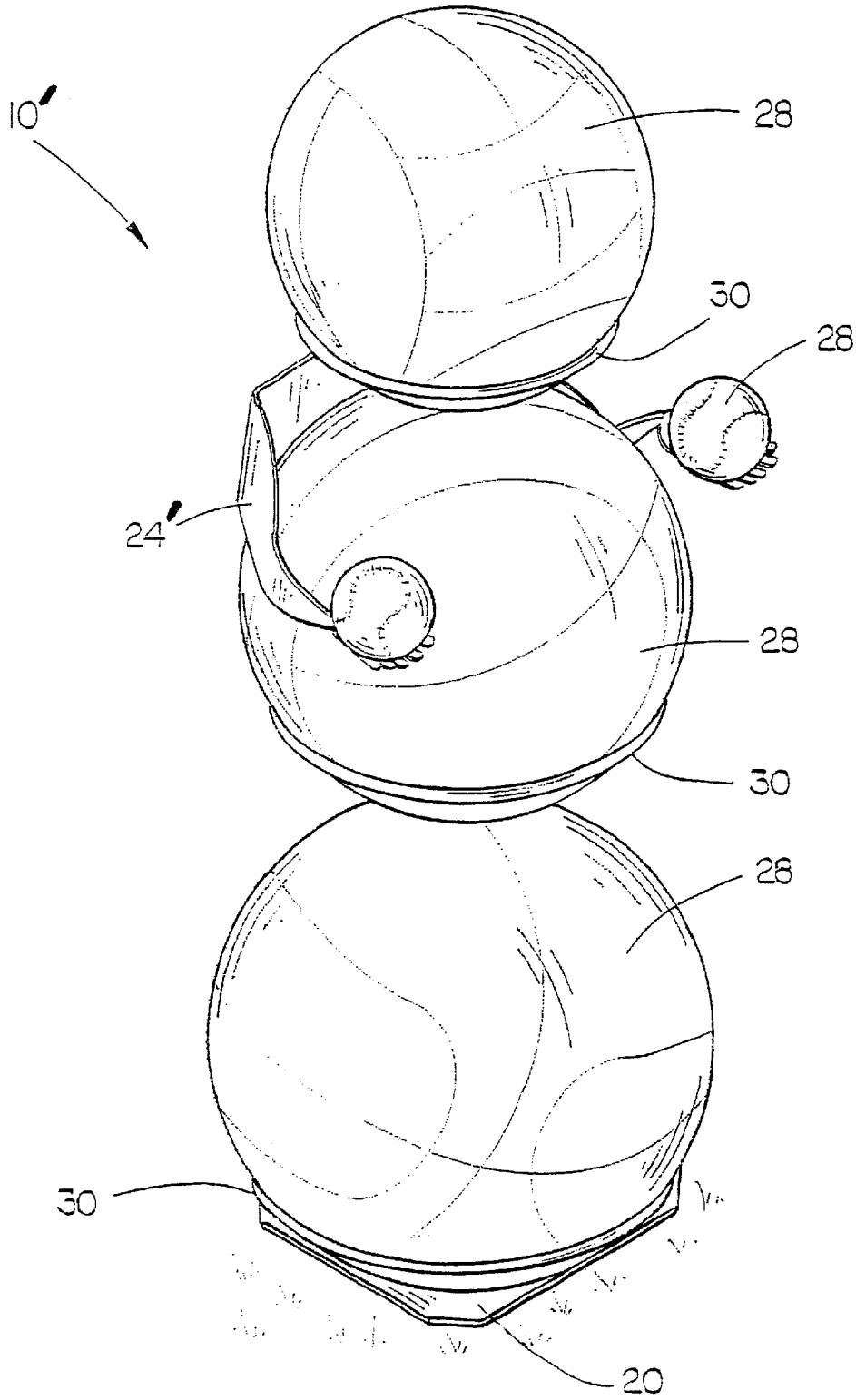
FIG. 4 is a perspective view of the invention in use, displaying a "sportball man" character.
Figure 5:
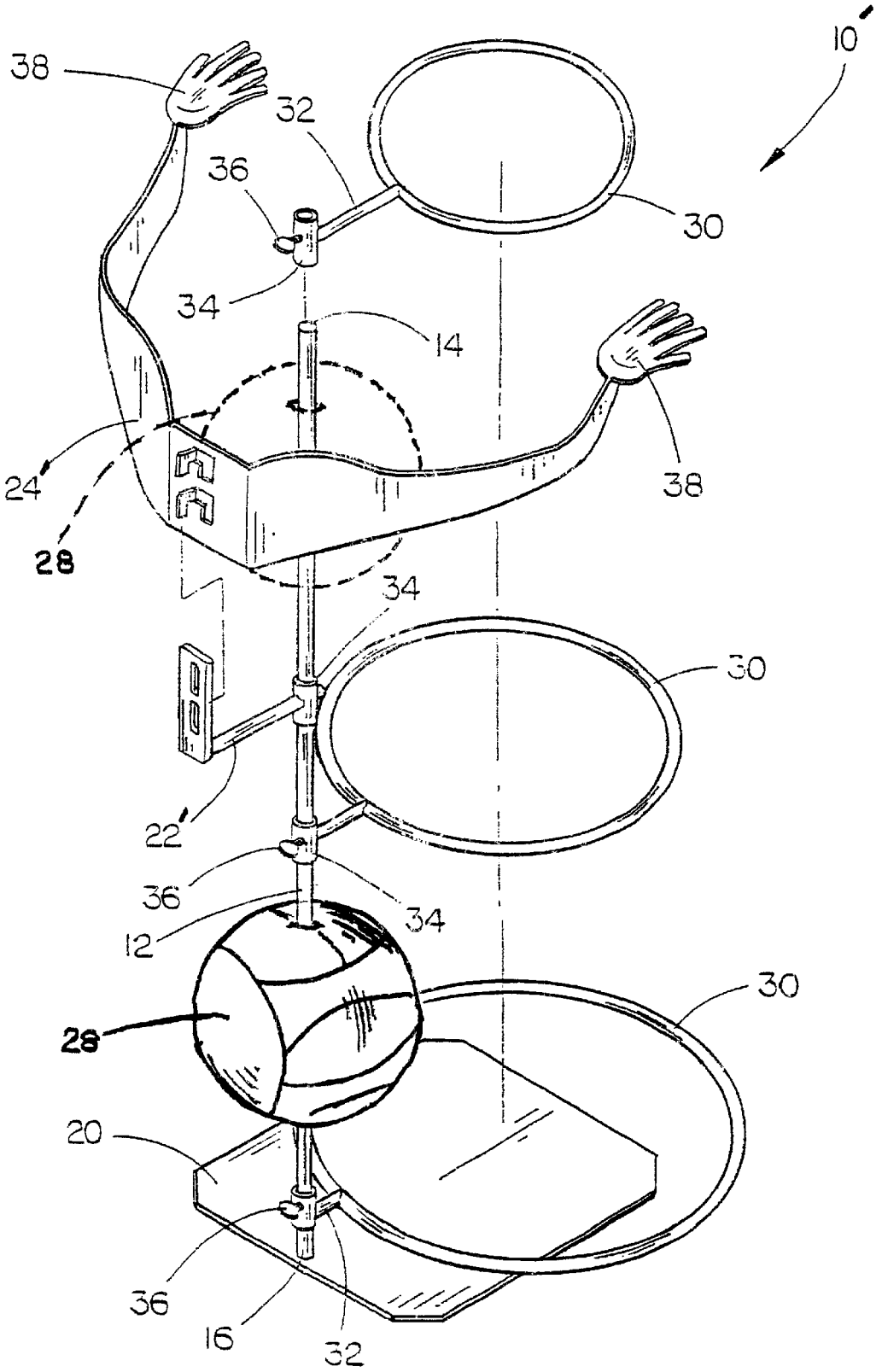
FIG. 5 is a rear perspective view of the invention in use with a stand and adjustable ring platforms and angular bracket.
Figure 6:
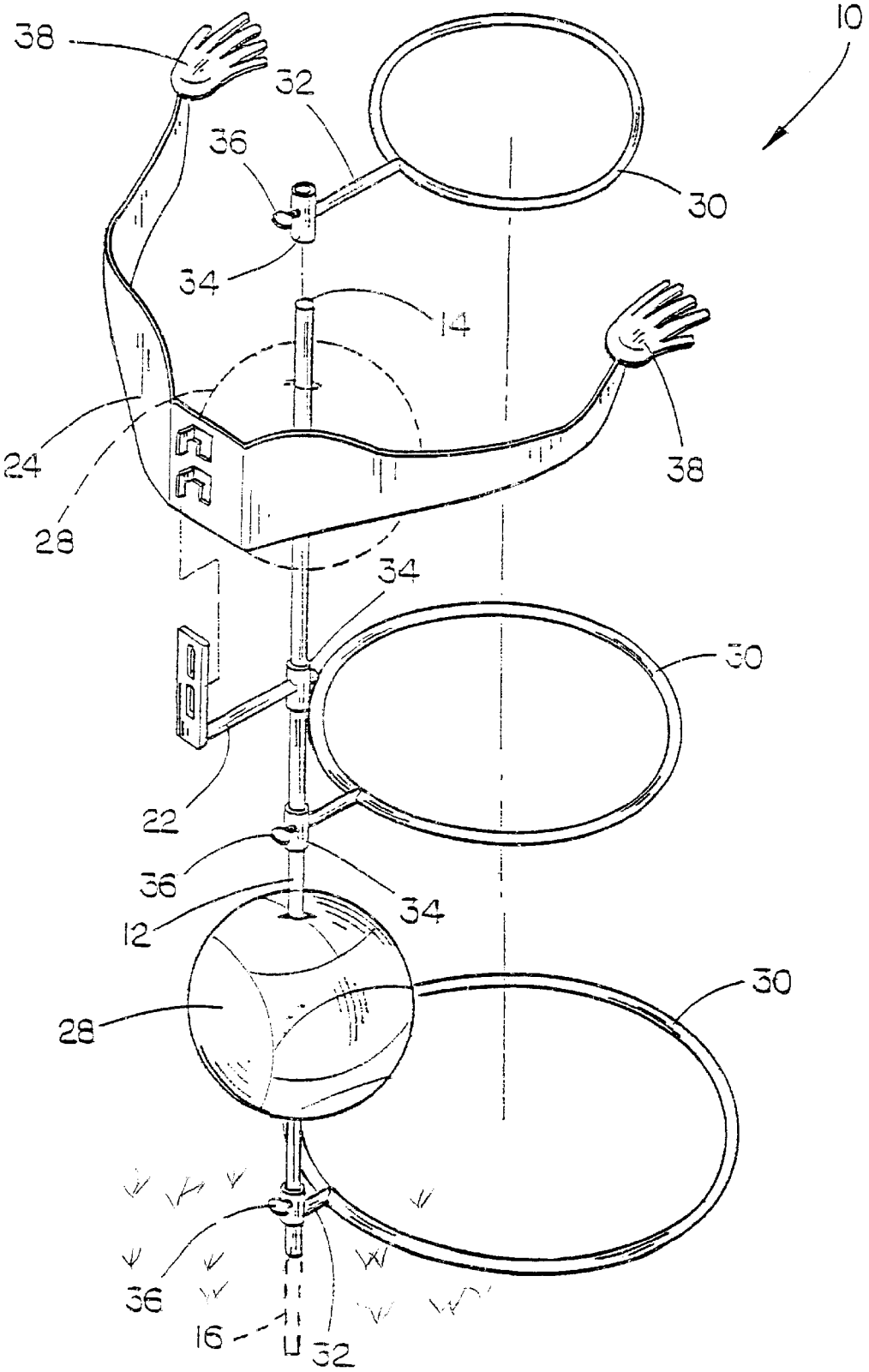
FIG. 6 is a rear perspective view of the invention in use with the rod inserted directly into the ground and adjustable ring platforms and an angular bracket.

The numerals 10 and 10', shown in FIGS. 1–5, refer generally to the method and apparatus for supporting and displaying at least one item of agricultural produce or sporting equipment as a selected theme character. FIGS. 1 and 2 depict the apparatus as it could be used to form a pumpkin man character. FIG. 4 depicts the apparatus as it could be used to form a sportball man. As shown in FIGS. 2, 3, and 5, the apparatus 10 and 10' generally include an elongated bar 12, having a first end 14 and second end 16. The bar 12 can be composed of nearly any material. However, the bar 12 should be sturdy and adapted to be rust prohibitive, since it may have to endure the elements when displayed out of doors. Materials such as rigid plastic, treated wood, or a metal, such as iron, steel, or aluminum that was coated with a rust prohibitive material would suffice to fashion the bar 12. Similarly, each of the remaining structural components could be made from any number of materials, although it is preferred that the same material be used for each of the components.

In a basic preferred embodiment for displaying the character outside of a home or business, the second end 16 of rod 12 is inserted directly into the ground so that the rod 12 extends generally perpendicularly from the ground. If an agricultural theme is preferred, at least one item of agricultural produce 18, such as a pumpkin, is adapted to have opposing holes in the sides thereof. The first end 14 of rod 12 is then inserted into the opposing holes in the produce 18, threading the produce 18 into place. This process is repeated until the character's desired height, or number of produce 18, is reached. The produce 18 can be further adapted with carvings or markings to create details, such as a face. This can be done using any traditional method of carving or marking material, including paint, markers, or the like. Moreover, the agricultural produce 18 can be adorned with craft items, clothing, or the like. The process described for securing the produce 18 to rod 12 would be carried out in similar fashion when a sport theme is desired. However, when a sport theme is desired, nearly any type of sporting equipment 28, such as sport balls (basketballs, soccer balls, footballs, etc.), helmets, pads, jerseys, etc., would be used in place of produce 18.

When it is not desirable to put holes into the produce 18 or equipment 28 to pass the rod 12 therethrough, a series of ring platforms 30 can be used to support the produce 18 or equipment 28 in a shelf-like manner. It is preferred that ring platform 30 be generally ring-shaped to allow the produce 18 or equipment 28 to set securely on the upper surface, and at times be partially disposed through the center opening, of the ring platform 30. However, it is contemplated that other structures including flat, solid plates or curved bowls could be used.

Ring platform 30 is provided with an arm member 32 that is attached to the outer edge of ring platform 30 and extends outwardly therefrom in a generally perpendicular manner. Collar 34, having opposite open ends that form an opening extending the length of collar 34 and having a diameter that is generally equal to that of rod 12, is preferably disposed at the opposite end of arm member 32. Rod 12 is inserted into the opening extending between the open ends of collar 34, allowing collar 34 and arm member 32 to be positioned at any point along the length of rod 12 between the first end 14 and the second end 16. Collar 34 is disposed onto the opposite end of arm member 32 so that, when collar 34 is placed onto rod 12, the arm 32 extends outwardly from rod 12 in a generally perpendicular manner positioning ring platform 30 generally horizontal to the display surface. Once the collar 34 and arm member 32 are located at the desired location along the length of rod 12, the location can be secured with a set screw 36 that is screwed perpendicularly through collar 34 and tightened against the rod 12. It is contemplated that other structures and methods generally known in the art, such as a spring force or a notch and pin assembly, could be used to secure the location of arm member 32 along the length of rod 12.

When it is not desirable to insert rod 12 directly into the ground, such as when the character is to be displayed on a surface such as concrete or inside a home or business, a stand 20 is secured to the second end 16 of rod 12. Stand 20 generally has an upper and lower surface. It is preferred that the topography of the lower surface of stand 20 be commensurate with the shape of the displaying surface, which will typically be flat. It is contemplated that pads of various materials could be placed on the lower surface to contact the displaying surface. While the stand 20 in FIG. 5 is depicted as being generally rectangular, it is contemplated that the stand 20 could be formed into any conceivable shape including that of feet for the character.

It is preferred that the stand 20 be secured to the second end 16 of rod 12 so that the rod 12 extends generally perpendicularly from the stand 20, thus promoting the stability of the apparatus 10'. The stand 20 can be secured to the second end 16 of rod 20 in a fixed or "permanent" manner. However, for ease of disassembly and storage, it is preferred that the second end 16 of rod 12 and the upper surface of stand 20 be adapted to be removably coupled together. This can be accomplished by adapting both components with mating threads to screw the two components together, adapting the stand with a collar 34 (of varying length) and an optional set screw 36, or other generally known methods.

It may be desired to provide the character with a set of arms. An elongated arm platform 24, having an upper surface 38 and a lower surface (not pictured), can be easily secured to the rod 12 in a number of ways. It is contemplated that arm platform 24 could be formed using two or more separate platforms that join into one or more sets of arms, as desired. It is preferred that an angular bracket 22, having first and second ends, be provided to secure arm platform 24 to rod 12. Although other known methods and structure could be used, it is preferred that arm platform 24 either be provided with receiving tabs, as shown in FIG. 3, through which the first end of angular bracket 22 can be inserted to support arm platform 24, or hook tabs, as shown in FIG. 5, which can be received by openings disposed within the angular bracket 22', adjacent the first end thereof.

The second end of angular bracket 22' can be attached to rod 12 in a fixed position. However, it is preferred that the second end of angular bracket 22' be secured to rod 12 in an adjustable and removable manner. Collar 34, as described previously, is preferably disposed at the second end of angular bracket 22. The rod 12 is inserted into the opening extending between the open ends of collar 34, allowing collar 34 and angular bracket 22' to be positioned at any point along the length of rod 12 between first end 14 and second end 16. Collar 34 is disposed onto angular bracket 22' so that, when collar 34 is placed onto rod 12, the angular bracket 22' extends first outwardly from rod 12 in a generally perpendicular manner and then upwardly in a generally parallel manner with respect to rod 12. Once the collar 34 and angular bracket 22' are located at the desired location along the length of rod 12, the location can be secured with a set screw 36 in the manner described previously.

Arm platforms 24 and 24' are preferably shaped so that they have two hands, one disposed at each end of the arm platforms 24 and 24'. When the hands are positioned so that the palms of the hands form an upper surface 38, the arm platforms 24 and 24' can be used to display a character with its arms outstretched, holding any number of items, including additional produce 18 or equipment 28.

In the drawings and in the specification, there has been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. An apparatus for supporting and displaying a plurality of objects as a selected theme character, comprising:

an elongated rod having first and second ends; and an elongated arm platform, having opposite hand-shaped ends, operatively connected to said rod so that the hand-shaped ends extend outwardly from said rod to selectively support at least one of the objects;

said first end of said rod being adapted to be inserted through at least one of the objects such that a character is formed having a theme related to the plurality of objects.

2. The apparatus of claim 1 wherein the second end of said elongated rod is adapted to be secured into the ground.

3. The apparatus of claim 1 further comprising a stand having a generally flat lower surface and an upper surface; said lower surface being adapted to be placed on a display surface; said upper surface being adapted to be removably secured to the second end of said rod so that said rod extends generally perpendicularly from said upper surface.

4. The apparatus of claim 1 further comprising a stand having a generally flat lower surface and an upper surface; said lower surface being adapted to be placed on a display surface; said upper surface being connected in a fixed position on the second end of said rod such that the rod extends generally perpendicularly from said upper surface.

5. An apparatus for supporting and displaying objects as a selected theme character, comprising:

an elongated rod having first and second ends;

an elongated arm platform, having opposite hand-shaped ends, operatively connected to said rod so that the hand-shaped ends extend outwardly from said rod to selectively support at least one of the objects; and at least one supporting platform having upper and lower surfaces:

said at least one supporting platform being adapted to be operatively secured to the rod between the first and second ends thereof;

said at least one supporting platform being further adapted to support at least one of the objects on the upper surface of said at least one supporting platform;

said at least one supporting platform being arranged with respect to said rod such that a character is formed having a theme related to the objects.

6. The apparatus of claim 5 wherein said at least one supporting platform is comprised of a generally ring-shaped body having outer and inner edges.

7. The apparatus of claim 6 wherein said at least one supporting platform is further comprised of an arm, having first and second ends; said first end of said arm being attached to the outer edge of the generally ring-shaped body so that the arm extends radially therefrom in general planar harmony with the generally ring-shaped body; said second end of said arm having a first elongated collar, having first and second open ends, attached thereto; said first elongated collar being adapted to receive said rod through said first and second open ends and be selectively and adjustably secured to the rod between the first and second ends thereof.

8. The apparatus of claim 5 wherein the second end of said rod is adapted to be secured into the ground.

9. The apparatus of claim 5 further comprising a stand having a generally flat lower surface and an upper surface; said lower surface being adapted to be placed on a display surface; said upper surface being adapted to be removably secured to the second end of said rod so that said rod extends generally perpendicularly from said upper surface.

10. The apparatus of claim 5 further comprising a stand having a generally flat lower surface and an upper surface; said lower surface being adapted to be placed on a display surface; said second end of said rod being connected in a fixed position to the upper surface of on the stand such that the rod extends generally perpendicularly from said upper surface.

11. A method for providing an amusing character having an elongated rod, with first and second ends, an elongated arm platform having opposite end portions, and a plurality of objects, comprising the steps of:

coupling the rod to the arm platform so that the opposite end portions of the arm platform extend outwardly from the rod;

shaping and positioning the opposite end portions of the arm platform to resemble hands capable of supporting at least one of the objects;

inserting the first or second end of the rod through at least one of the objects; and arranging the rod, the elongated arm platform, and at least one of the objects with respect to one another such that a character is formed, having a theme related to that of the objects.

12. The method of claim 11 further comprising the step of securing the second end of said rod into the ground to provide further structural support and stability to the character.

13. The method of claim 11 further comprising the step of removably securing a stand to the second end of said rod, such that the rod extends generally perpendicularly from the stand, to display the character on a selected display surface.

14. The method of claim 11 further comprising the step of securing the second end of said rod to a stand in fixed relationship therewith, such that the rod extends generally perpendicularly from the stand to display the character on a selected display surface.

15. A method for providing an amusing character having an elongated rod with first and second ends, an elongated arm platform having opposite end portions, at least one supporting platform having upper and lower surfaces, and a plurality of objects, comprising the steps of:

coupling the rod to the arm platform so that the opposite end portions of the arm platform extend outward from the rod;

shaping and positioning the opposite end portions of the arm platform to resemble hands capable of supporting at least one of the objects;

operatively and adjustably securing the at least one supporting platform to the rod between the first and second ends thereof, so that the at least one supporting platform extends generally perpendicularly from the rod;

supporting at least one of the objects on the upper surface of the at least one supporting platform; and arranging the rod, at least one supporting platform, arm platform, and objects with respect to one another such that a character is formed having a theme related to that of the objects.

16. The method of claims 15 further comprising the step of securing the second end of said rod into the ground.

17. The method of claim 15 further comprising the step of securing the second end of said rod to a stand in fixed relationship therewith, such that the rod extends generally perpendicularly from the stand, to display the character on a selected display surface.

* * * * *